United States Patent [19]

Ule et al.

[11] 4,000,756

[45] Jan. 4, 1977

[54] HIGH SPEED ENGINE VALVE ACTUATOR

[76] Inventors: Louis A. Ule, 27 Mustang Road, Rolling Hills, Calif. 90274; Gunnar P. Michelson, 7416½ Sepulveda Blvd., Van Nuys, Calif. 91405

[22] Filed: Oct. 6, 1975

[21] Appl. No.: 619,648

Related U.S. Application Data

[62] Division of Ser. No. 454,683, March 25, 1974, Pat. No. 3,926,159.

[52] U.S. Cl. ..... 137/596.17; 123/90.11; 123/90.12; 251/30

[51] Int. Cl.[2] ..... F16K 31/12

[58] Field of Search ..... 251/30; 137/596.17, 137/596.16, 596.2; 123/90.12, 90.13, 90.11

[56] References Cited

UNITED STATES PATENTS

| | | | |
|---|---|---|---|
| 685,741 | 11/1901 | Clarke | 251/30 |
| 2,785,638 | 3/1957 | Moller | 137/596.17 |
| 3,294,120 | 12/1966 | Ruchser | 251/30 |
| 3,399,689 | 9/1968 | Keane | 137/596.17 |
| 3,520,511 | 7/1970 | Warne | 251/30 |
| 3,904,167 | 9/1975 | Touch | 251/30 |
| 3,926,159 | 12/1975 | Michelson | 123/90.11 |

*Primary Examiner*—Charles J. Myhre
*Assistant Examiner*—Daniel J. O'Connor
*Attorney, Agent, or Firm*—Dominick Nardelli

[57] ABSTRACT

An electro-hydraulic system capable of high speed and precision timing, is disclosed, particularly adapted to the opening and closing of the intake and exhaust valves of an internal combustion engine under computer control. The actuator is powered by pressurized crankcase oil which is discharged on the engine valve stems for lubrication. The system employs hydraulic cushioning to reduce engine valve seating velocity, and recovers energy on the return stroke of the valve to improve efficiency. High speed is achieved by rapid de-energization of electromagnets which hold the fluid control valves closed against the force of the pressure of the hydraulic supply. These electromagnets latch the valves in their most power-efficient mode, that is, with the magnetic circuit gap at or near zero.

4 Claims, 4 Drawing Figures

HIGH SPEED ENGINE VALVE ACTUATOR

This application is a divisional of our copending application Ser. No. 454,683 filed Mar. 25, 1974, now U.S. Pat. No. 3,926,159.

FIELD OF THE INVENTION

The present invention relates to the art of operating fluid valves, requiring high power for their actuation, at high speed and with high precision. In particular, it offers the capability of improved opening and closing of the intake and exhaust valves of an internal combustion engine by timed electrical signals.

BACKGROUND OF THE INVENTION

A major obstacle to the more efficient operation of internal combustion engines, and of many other contrivances that employ fluid valves, is the power required to open and close such valves at high speed. This power often exceeds the power that can be developed by a practical solenoid actuator and through hydraulic actuators controlled by servo-valves are capable of supplying the necessary speed and force, these latter are both expensive and excessively inefficient. For nearly a century the intake and exhaust valves of internal combustion engines have therefore employed a camshaft and heavy valve springs to provide the high force required to open and to close, respectively, intake and exhaust valves. This rigid, inflexible and "brute force " method of valve actuation is devoid of all possibility of adapting the timing of valve opening and closing to the variable speed and load of the engine, with the consequence that engine torque and efficiency are sacrificed at both low and high speeds. The choice of the cam profile for the camshaft of an internal combustion engine is a compromise which has no truly satisfactory solution.

In a previous patent application, "Programmed Valve System for Internal Combustion Engines," Ser. No. 306,399, filed Nov. 14, 1972, as a continuation-in-part of a prior patent application, Ser. No. 125,520, filed Mar. 14, 1971, both assigned to the assignee of the present application, two classes of engine valve actuators were described, both hydraulically powered; one in which the valve actuators were controlled by engine-driven hydraulic control valves whose timing was susceptible to computer control, and a second class in which the engine valve actuators were controlled by a single-stage solenoid hydraulic valve. In that prior patent application, means were also shown for operating the solenoid at high speed and high efficiency, using inductors as energy storage and recovery means. In a subsequent patent application, "High Speed Electromagnet Control Circuit," Ser. No. 377,956, filed July 10, 1973, as a continuation-in-part of a prior patent application, Ser. No. 308,268, filed Nov. 21, 1972, an improved circuit was described for the high speed, high efficiency control of electromagnets by means of switching circuits only.

Both of the copending aforementioned U.S. patent applications, Ser. Nos. 306,399, filed Nov. 14, 1972, and 377,956, filed July 10, 1973, are incorporated herein by reference.

SUMMARY OF THE INVENTION

The present invention is a hydraulically powered two-position actuator adapted to the opening and closing of the intake and exhaust valves of an internal combustion engine under electronic control and at high speed and efficiency. Increased speed and efficiency over previous methods are made possible by reducing the power required of the solenoid for the actuation of the hydraulic fluid control valves. The solenoids and associated electromagnets are not required to produce a high force over the full travel of the associated hydraulic control valves, but are only required to produce a high force in the closed position, when the magnetic air gap is zero or at least small. Correspondingly, the electrical power required is also small, in which position the magnetic force holds the hydraulic control valve closed against the force of hydraulic pressure. When the solenoid is de-energized, the hydraulic control valve is forced open at high speed by the pressure of the hydraulic fluid. The inlet and outlet valve to the cylinder of a hydraulic actuator are alternately held closed against the supply pressure by their respective solenoids, which are alternately energized. When the inlet, solenoid-controlled valve is opened, the hydraulic supply pressure acts upon the actuator piston (the outlet, solenoid-controlled valve meanwhile being held closed) driving it to its extreme position, after which time the inlet control valve acts as a check valve to prevent return of hydraulic fluid to the supply. When the outlet valve is released, the inlet valve (having already closed) is held closed against the increasing force acting to open it as pressure in the cylinder drops. In the absence of magnet force acting to close an inlet or outlet control valve, these valves are returned to their closed position by return springs. The requirement for hydraulic power is reduced by three ancillary means; first, a buffer which allows pressure to build up from a constant flow hydraulic supply to provide a high peak pressure for actuator operation initially, while allowing a lower average hydraulic supply pressure and power requirement; second, by not hydraulically driving the engine valve to a stop which absorbs its kinetic energy, but by using its kinetic energy to compress the engine valve spring and then to lock it hydraulically when its speed has dropped to zero; and, third, by recovery of part of the kinetic energy of the load (typically, the engine intake or exhaust valve and associated spring), this kinetic energy being used to return part of the fluid in the actuator cylinder to the supply.

DETAILED DESCRIPTION OF THE DRAWINGS

Figure 1:
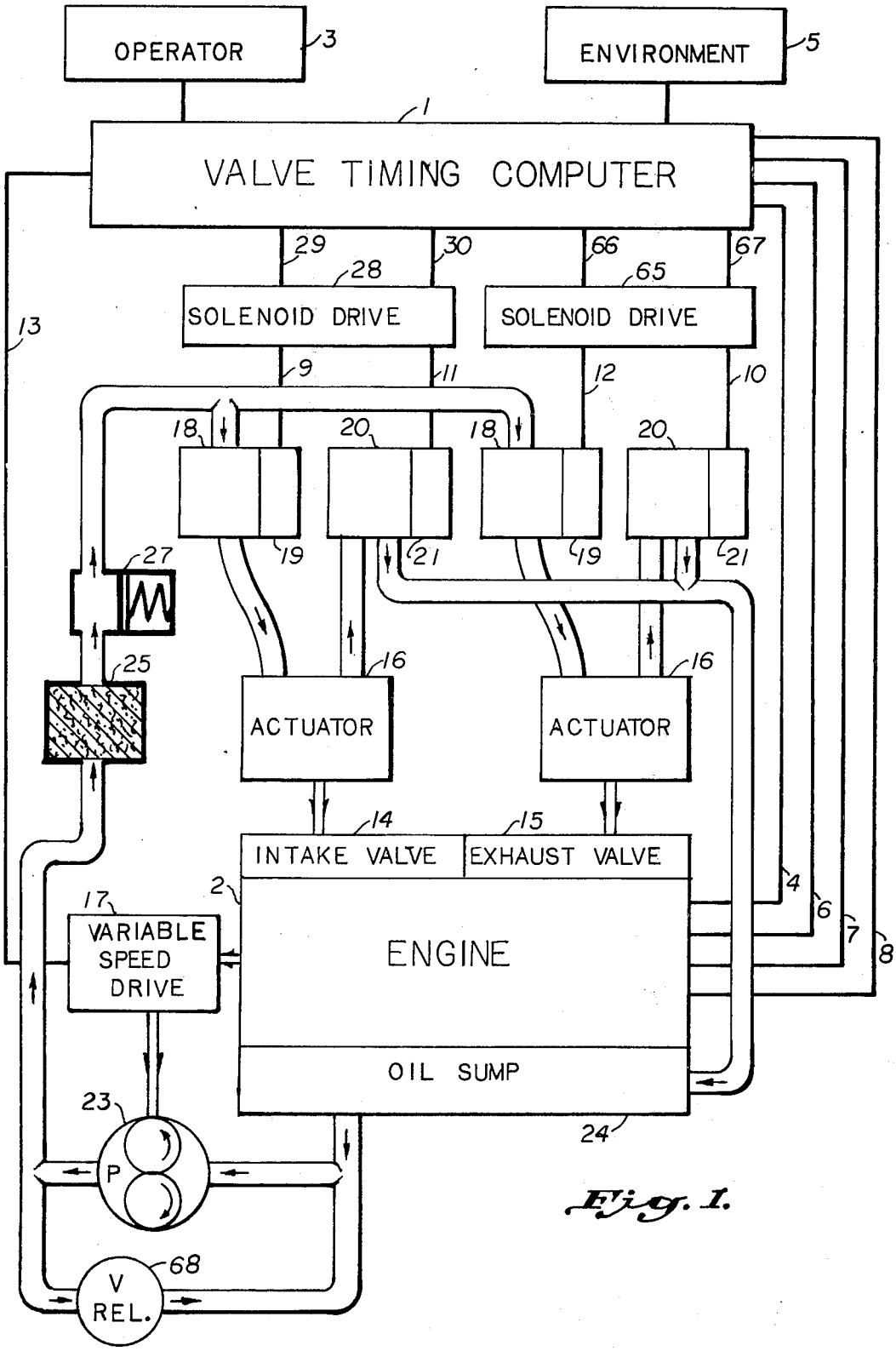
FIG. 1 is a block diagram of an internal combustion engine in which the intake and exhaust valves are operated by hydraulically powered actuators under computer control, according to the invention.

Unlike a conventional camshaft used to open and close the intake and exhaust valves of an internal combustion engine, electro-hydraulically controlled engine valve actuators require a separate timing circuit or computer to determine the optimum opening and closing times under varying conditions of engine operation, such as low speed or high speed, forward or reverse, acceleration or deceleration. A typical computer-controlled valve actuating system is shown in FIG. 1 where a computer 1 receives a variety of input data from an operator 3, the environment 5, and an engine 2. Such data are used to compute timing signals 29, 30, 66 and 67 for valve actuators 16, as well as control signals for other functions not shown in FIG. 1, such as ignition and fuel metering. Operator data include such commands as start, accelerate, decelerate and reverse, such data being communicated to the computer by transducers which are the equivalent of the accelerator pedal and other conventional controls. Environmental data are principally air temperature and air density. Data that the computer requires of the engine are instantaneous crank angle 4, intake manifold temperature 6, and possibly other data such as onset of detonation. Typical computer outputs required for the proper operation of the engine are fuel flow rate 7, ignition timing 8, intake valve open commands 9, intake valve close commands 11, exhaust valve open commands 12, exhaust valve close commands 10, and the desired valve lift 13. Each intake valve (shown typically as 14) or each exhaust valve (shown typically as 15) is controlled by a hydraulic actuator 16. The computer design, per se, does not form a part of the present invention, but is well documented in the aforementioned U.S. patent application Ser. No. 306,399. Description of such matters as contained herein are for the purpose of establishing an environment for the present invention and to indicate its particular utility in an illustrative system. Each inlet control valve 18 is under the control of a solenoid 19. In like fashion, each outlet control valve 20 is under the control of a solenoid 21. A pair of solenoids 19 and 21 are alternately energized by outputs 9 and 11, respectively, from an electronic drive circuit 28 responsive to computer commands 29 and 30 for the opening and closing of the engine intake valves. A like pair of solenoids 19 and 21 are alternately energized by outputs 12 and 10, respectively, from an electronic drive circuit 65 responsive to computer commands 66 and 67 for the opening and closing of the engine exhaust valves.

The hydraulic actuators 16 are powered by high-pressure oil, pressurized and moved by the fixed displacement oil pump 23, drawing engine lubricating oil from the oil sump or crankcase 24 of the engine 2. The oil drawn from sump 24 is normally filtered by a conventional filter screen, not shown, to prevent damage to the pump 23 and is further filtered downstream of the pump 23 by high-pressure filter 25. Since the pump 23 is driven by the engine by means of a variable-speed drive 17, the pressure adapts itself automatically to the current requirement for valve lift, pressure relief valve 68 acting to prevent excessive pressure surges and the hydraulic buffer 27 acting to produce desirable peak pressures for the initial opening of engine exhaust valves particularly, and yet allow a substantially lower average hydraulic pressure. Since the required hydraulic fluid flow rate is generally proportional to engine speed, the setting of variable speed drive is constant for a constant valve lift, regardless of engine RPM. However, it is desirable to reduce valve lift at low engine speeds, particularly for the engine intake valves, in order to produce a high inlet velocity for the fuel-air charge needed to adequately mix the fuel and air for reliable and complete combustion. The reduced valve lift at low engine speeds is produced by an appropriate setting of the variable speed pump drive 17 in response to computer command 13 which reduces the flow of hydraulic fluid, viz., engine lubricating oil, to the actuators 16. The reduced valve lift at low engine speeds not only improves engine efficiency, but also reduces the hydraulicf power requirement and the parasitic load on the engine 2 required to drive the pump 23. Some reduced valve lift at low speeds is obtained, even without a variable speed drive 17, as the natural consequence of the reduced low-speed volumetric efficiency of most gear or rotary vane pumps, a factor that can be taken into account in computing the control parameter 13 for the variable speed drive 17.

Figure 2:
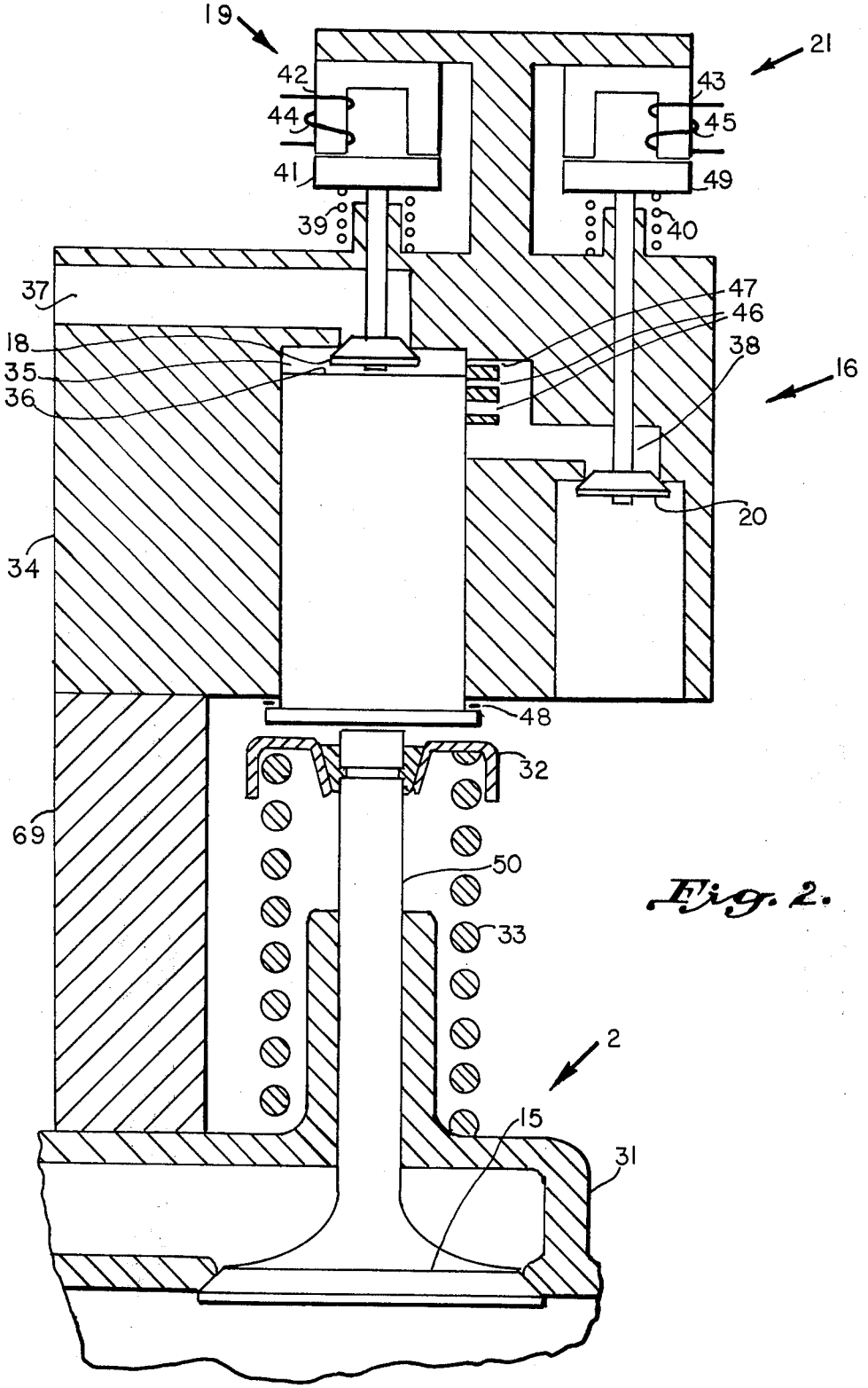
FIG. 2 is a semi-schematic, cross-sectional view of a typical actuator of the invention mounted over a valve of an internal combustion engine.

The relative position of the actuator 16 and an engine intake or exhaust valve is shown in FIG. 2. High pressure engine lubricating oil, used as a hydraulic fluid, enters passage 37 and is eventually discharged at relatively high velocity from the outlet control valve 20, situated above and adjacent to the engine intake or exhaust valve stem 50. This rather violent discharge of lubricating oil from the actuator 16 provides ample lubrication of engine valve stem guides and replaces the conventional means of lubrication based on delivery of oil to the guides from oil galleries supplying the tappets via hollow push rods. The components of the engine intake and exhaust valve mechanisms are otherwise conventional and include the cylinder head 31, an intake or exhaust valve 15, a valve stem 50, a spring retainer 32 secured to the valve stem 50, and the valve spring 33 which holds the valve 15 in its closed position. The hydraulic actuator 16 is mounted to the cylinder head 31 by means of a structure 69 which may be a portion of the actuator housing 34.

The hydraulic actuator 16 is comprised of a housing 34, a hydraulic cylinder 35, a piston 36, a high-pressure oil inlet passage 37, the oil inlet control valve 18, the oil outlet control valve 20, control valve return springs 39 and 40, and the control valve holding solenoids 19 and 21.

In typical operation, when the engine valve 15 is closed, inlet control valve 18 will be held closed against the force of the hydraulic supply pressure by the currently energized holding solenoid 19. Meanwhile, a solenoid 21 is de-energized, allowing outlet control valve 20 to open to relieve any incidental pressure buildup in the hydraulic cylinder 35 that might be caused by leakage of inlet control valve 18. Conversely, when the engine valve 15 is open, outlet control valve 20 is held closed by holding solenoid 21, now energized, while solenoid 19, now de-energized, allows the inlet control valve 18 to open to allow the full supply pressure to act upon the cylinder 36 and to constantly supply any leakage through outlet valve 20. Due to the inertia of the engine valve 15, it will, after being accelerated to a high speed, compress the valve spring 33 to a greater degree than possible by static supply pressure alone acting on the piston 39. When the engine valve 15 and the piston 36 approach a standstill, the relatively slight force of return spring 39 will close the inlet control valve 18 which prevents the return of hydraulic fluid to the supply. Typically, in this condition, the hydraulic fluid trapped in cylinder 35 will attain a pressure nearly twice that of the supply pressure, corresponding to a valve lift nearly twice that obtainable from the average supply pressure only. Operation of inlet valve 18 as a check valve in the manner just described, in addition to providing double valve lift, suppresses the oscillatory motion of the valve 15 that would otherwise ensue.

The holding solenoids 19 and 21 are energized by current flowing through windings 44 and 45, respectively, which current creates a magnetic flux that produces a strong attractive force between armature 41 and stator 42 for solenoid 19, and between armature 49 and stator 43 for solenoid 21. Since the armatures 41 and 49 are mechanically secured to the associated control valves 18 and 29, these valves are held in their closed positions by the holding currents in windings 44 and 45, respectively.

Opening of an engine valve 15 is achieved by the mechanical force of piston 36 mounted directly over the associated engine valve stem 50, this mechanical force being opposed both by the inertia of the valve and the force of the valve spring 33. The engine valve 15, initially accelerated by the superior force of piston 36, eventually decelerates as the force of the compressed spring comes to exceed the force of the piston 36, coming to rest at the point of maximum lift in consequence of both inlet and outlet control valves 18 and 20 being held closed, the former as check valve in response to the higher hydraulic pressure in cylinder 35, and the latter by energized solenoid 21.

The closing of the engine valve 15 is effected by the de-energization of solenoid 21 and the energization of solenoid 19. In either case, very little work is done by the respective solenoid since the inlet control valve 18 is closed prior to energizing solenoid 19, and the outlet valve 20 is opened by the force of hydraulic pressure in cylinder 35 and connected passage 38, once the holding force of solenoid 21 is removed. This hydraulic pressure in cylinder 35 is the result of the force of the engine valve spring 33 acting on piston 36 via the valve spring retainer 32 and the valve stem 50. At the instant that the outlet control valve 20 is opened, the hydraulic pressure in cylinder 35 drops abruptly and the engine valve 15 and piston 36 are accelerated by the force of the engine valve spring 32 to their closed positions. Unless means are used to prevent it, the closing speed of engine valve 15 would be excessively high. Therefore piston 36 closes off the main outlet passage 38 to gradually produce a braking force which acts on the said piston and which is opposed to the force of the engine valve spring 33. When the hydraulic braking force becomes equal to the spring force, the engine valve 15 and the piston 36 are at their maximum speed and thereafter their speed decreases since the hydraulic braking force then exceeds the spring force. When the piston 36 has completely blocked the large outlet passage 38, the pressure in cylinder 35 will have reached a rather high value, since the oil can now escape only through the throttling passages 46 and the bleeder passage 47. The number, diameter and the location of the throttling passages 46 are selected to provide a nearly constant deceleration to an acceptably low-seating velocity for engine valve 15. After the engine valve 15 is seated in its closed position, only the very small bleeder passage 47 remains open for the purpose of assuring that piston 36 cannot come to a full stop prior to the seating of valve 15 in its closed position.

When the piston 36 has come to a stop, the flow through the outlet control valve 20, which had held said valve open, has ceased, enabling the relatively weak force of return spring 40 to close the outlet control valve 20. Thus the work required to close this valve 20 is supplied indirectly by the hydraulic supply pressure by energy stored in the return spring 40 so that subsequent energization of solenoid 21 is not required to produce mechanical work but only a holding force sufficient to hold outlet control valve 20 closed against the hydraulic pressure. Although this holding force is far in excess of that which can be supplied by return spring 40, it requires relatively little electrical energy. Thus, with outlet control valve 20 held closed only by the return spring 40 to prevent pressure buildup in cylinder 35 from any leakage from inlet control valve 18, the actuator is in a state ready for the near instantaneous opening of the engine valve 15 on the next cycle, effected by the de-energization of solenoid 19 and the energization of solenoid 21. To avoid engagement shock between actuator piston 36 and engine valve stem 50 when the piston is actuated, a light spring or wave washer 48 is placed between the shoulder of the piston 36 and the housing 34.

Since the engine valve actuator, as described, is capable of producing a mechanicl response within a very short period of time, that is, in the order of one millesecond or less from the time of receipt of computer commands 29, 30, 66 or 67 (FIG. 1), the time required to fully open and close an engine valve is determined essentially by the resonant period of the engine valve 15 and valve spring 33 combination. In addition to the mass of engine valve 15, there are contributions to inertia from the valve spring 33 and the piston 36. The opening time of the engine valve does not depend on the speed of the engine nor on the amount of the valve lift if a single linear valve spring 33 is used. The time for the valve to reach maximum lift will be one-half the resonant period of the mass-spring combination. The time to close, after the opening of outlet control valve 20, will be one-fourth of this period plus the time required to decelerate the piston, so that the time to fully open and subsequently close the engine valve 15 is between three-fourths and approximately 90% of the said resonant period at least, and may be made longer by delaying the "close" command. SInce the resonant period of a typical valve-mass/valve-spring combination is about 8 milleseconds, full open to full close times as short as approximately 6 to 7 milleseconds are attainable with conventional linear valve springs. This minimum open-to-close time, which is fully adequate for an internal combustion engine, can be made even shorter by the use of dual valve springs, a slight spring which allows a higher opening force and achieves a quicker opening of the valve. A second, much stiffer spring engages after sufficient valve lift has been attained and acts to quickly arrest valve motion and also to store energy for the rapid acceleration of the engine valve 15 to its subsequent closed position. Since valve open-to-close time is dependent on the valve-mass/-valve-spring resonant period, shorter open-to-close times can be attained by the use of stiffer springs and a corresponding increase in hydraulic power. Further, the time that an engine valve is open can be reduced by commanding it to close before it is fully open.

The hydraulic power required to operate the engine valves in the manner described is proportional to the square of the engine valve lift, the force of the engine valve spring, and the speed of the engine. The engine valve lift that will be attained and the resulting spring force depend on the setting of the variable speed drive 17. The valve lift is reduced at low engine speeds by means of the variable speed pump drive 17, which, in turn, causes the hydraulic pressure to drop. Typically, it requires about 5 foot-pounds of work to provide full valve lift but only approximately one-third this amount for one-half full lift, so that at low engine speeds a substantial saving in hydraulic power is possible.

Figure 3:
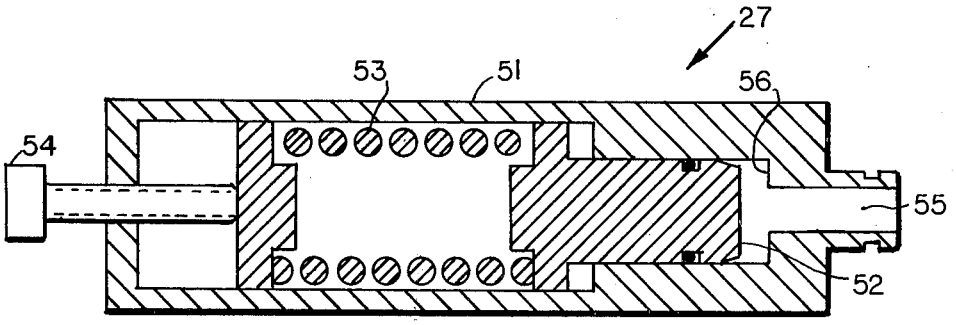
FIG. 3 is a cross-sectional view of the hydraulic buffer.

In addition to the average power requirement for engine valve operation, there is the need for a higher than average hydraulic pressure to open the exhaust valves against both the preload of the exhaust valve spring and the pressure of combustion products in the firing chamber. Pressure surges in the hydraulic supply suitable for the purpose are produced by the combination of a constant flow hydraulic pump and intermittent flow through the actuators 16 but, unless moderated, these pressure surges can be excessive. A properly tuned hydraulic buffer 27 (FIG. 3) serves both to smooth the intermittent flow to the actuators to a nearly constant flow supplied by the pump and to allow the pump output pressure to rise in the period between actuator cycles to a value that is sufficient to crack open the exhaust valves but not otherwise excessive. As typically, in a multi-cylinder internal combustion engine, the exhaust valve of one cylinder will open simultaneously with the opening of the intake valves of another cylinder, yet always so that the exhaust valves are opened first (a greater advance in the opening of exhaust valves being desirable), the full surge pressure will always be available to open an exhaust valve and a slightly depleted surge pressure will be more than adequate to open the intake valves immediately after. The tuning of the buffer to achieve the desired pressure surges is effected by a proper choice of spring constant for spring 53, taking into account the effect of any mechanical compliance in the hydraulic plumbing. The higher pressure required to open engine exhaust valves is only momentary, for once they are cracked open, any pressure in the firing chamber drops abruptly. A simple version of the buffer 27 is shown in FIG. 3 and consists of a hydraulic cylinder 51, a piston 52, the spring 53, and an adjusting screw 54 for the spring 53. The port 55 of the cylinder 51 is communicatively connected to the inlet control valves 19 of the actuators 16 and to outlet port of the high pressure oil filter 25 supplying oil from pump 23. Because of the finite spring rate of the spring 53, the oil pressure fluctuates periodically at a frequency equal to the frequency of operation of the engine valves. For example, when no actuator requires hydraulic fluid, the oil delivered by the oil pump 23 enters the buffer 27 through the port 55 and displaces piston 52 against the force of spring 53 and, as a consequence, the oil pressure rises. The rise in oil pressure is proportional to the displacement of piston 52 and the spring rate of spring 53. When, during this process, one of the actuator control valves 18 opens, the actuator 16 will require a larger oil flow than that provided instantaneously by pump 23, and this required additional flow is supplied by buffer 27, its piston 52 returning to its initial position. In this manner a synchronized pressure fluctuation is obtained, producing pressure surges when they are required, with a substantially lower average hydraulic supply pressure. A further favorable consequence of this buffered operation is that the initial acceleration of the engine valve will be higher, producing thereby an opening time less than one-half the resonant period as previously described.

The buffer spring 53 (FIG. 3) is selected so that its force range is adequate to meet the requirements for a fluctuating pressure at all pressure levels set by the computer 1 acting through the medium of variable speed drive 17 by command 13 (FIG. 1). At low pressure the piston 52 lies close to the bottom 56 of the buffer cylinder 51, and, at higher pressure, it operates a greater distance away.

The function of the buffer 27, just described, may be provided by any other suitable known type of hydraulic accumulator having the appropriate spring rate, such as a container partially filled with compressed gases. Since the buffer is a principal supplier of hydraulic fluid during the time of valve actuation, each actuator may be provided with its own buffer to minimize the hydraulic fluid supply delay occasioned by the inertia of fluid in relatively long supply lines. Further, a single buffer may be advantageously placed downstream of the actuators 16 so that said actuators may be supplied with hydraulic fluid from two directions for more rapid response.

Figure 4:
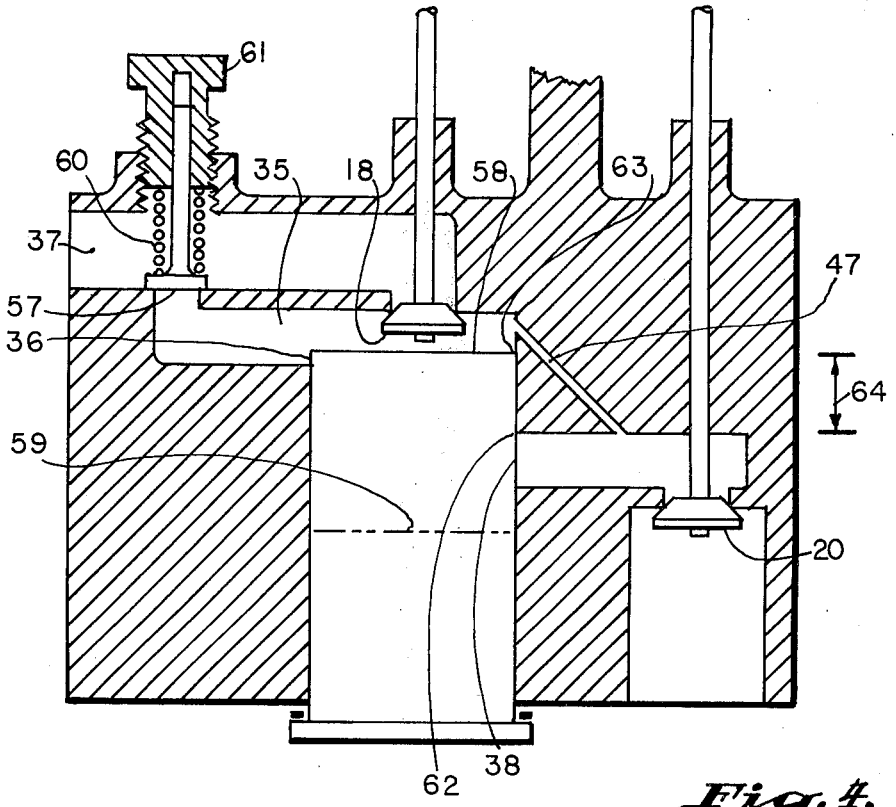
FIG. 4 is a cross-sectional view of the actuator incorporating a means for energy recovery.

Since, typically, the pressure in an energized actuator cylinder 35 will be nearly twice the average hydraulic supply pressure, it would, in principal, be possible to return a significant portion of this fluid to the supply with a consequent saving in hydraulic power. Such energy recovery can be achieved by replacing the throttling passage 38 (FIG. 2) with a relief valve between the actuator cylinder 35 and the inlet port 37, as shown in FIG. 4, where 57 is the added relief valve. When the engine valve 15 is open, the bottom 58 (FIG. 4) of the actuator piston 36 will be in the position depicted by the phantom line 59. The instant the outlet control valve 20 opens, the piston 36 will move upward, as described above, except that when it blocks passage 38, most of the fluid will now be forced through the relief valve 57 back into the high pressure line 37 and be available to power the next actuator cycle. A small portion of the hydraulic fluid will escape through the bleeder 47 which remains open at all times to insure proper seating of engine valve 15, as previously described. The force of the relief valve spring 60 is selected to prevent premature opening of valve 57 during the time that engine valve 15 is being held in its open position by the hydraulic pressure in chamber 35, since this latter pressure is substantially higher than the hydraulic supply pressure in inlet port 37. The optimum distance 64 between the closing edge 62 of the outlet passage 38 and the fixed locus defined by the edge 63 of piston 36 in its retracted position, as also the setting of the adjusting screw 61 for the force supplied by spring 60, depend on the pressure in the inlet passage 37, the energy recovery system just described when equipped with fixed settings will be most effective for a single-fixed engine valve lift. At larger engine valve lifts the valve seating will become hard since the kinetic energy of the valve is higher than the returned energy. At smaller engine valve lifts the valve will reach a slow speed before it is seated and will take longer to close since thereafter oil can be discharged only through the bleeder passage 47. Therefore, the energy recovery system described is effective only when a fixed or nearly constant valve lift is employed.

Modifications and variations within the scope of the invention will suggest themselves to those skilled in this art once the concepts of the invention are understood. For example, the foregoing system for operating the intake and exhaust valves of an internal combustion engine under computer control using engine lubricating oil as the hyraulic fluid may be replaced by a separate hydraulic system with a fluid reservoir, and conventional means for lubricating valve stem guides may be used in that event. As another example, the combination of a variable speed drive and a positive displacement pump may be replaced by a controllable variable displacement pump.

We claim:

1. An electro-hydraulic actuator comprising:

a housing having an open-ended cylindrical cavity formed therein, wherein said cavity has a bottom;

a piston having a bottom end and being slidably disposed within said cylindrical cavity with said bottom end disposed adjacent to the bottom of said cavity;

said housing having an inlet passage which communicates with said cavity through said bottom thereof forming an annular valve seat;

an inlet valve having a head and a stem with said head disposed within said cavity and said stem passing through said inlet passage so that said head is disposed to seal against said valve seat;

said housing having an outlet passage communicating with said cavity, substantially near the bottom thereof;

said housing having a duct communicating with said outlet passage and said duct having an annular valve seat formed at its end facing away from said cavity;

an outlet valve having a head and a stem, with said head thereof disposed to make contact with said valve seat of said duct and said stem thereof passing through said seat and through the wall of said duct to extend outside of said housing in journaled relationship therewith;

an inlet solenoid and an outlet solenoid mounted onto said housing;

said inlet solenoid, when energized, being disposed to urge said inlet valve against its respective valve seat; and said outlet solenoid, when energized, being disposed to urge the outlet valve against its respective valve seat.

2. The actuator of claim 1 wherein:

said outlet passage is disposed spaced from said bottom and through the side wall of said cavity so that said piston seals said outlet passage when fully disposed within said cavity; and said housing having a bleeder passageway communicating said duct with said cavity and being disposed adjacent to said bottom so that said piston cannot seal said bleeder passageway.

3. The actuator of claim 2 wherein:

said housing has at least one throttling passage communicating with said cavity and also with said duct so that said piston seals off said outlet passage first, and then said throttling passage.

4. The actuator of claim 2 wherein said housing has:

a high pressure duct communicating with said inlet passage;

a by-pass communicating said high pressure duct with said cavity in the region near the bottom thereof so that said piston cannot seal said by-pass; and a relief valve disposed within said by-pass to allow fluid to flow only from said cavity into said high pressure duct through said by-pass.

* * * * *